US008066279B2

(12) United States Patent
Ishikawa et al.

(10) Patent No.: US 8,066,279 B2
(45) Date of Patent: Nov. 29, 2011

(54) SHEET CONVEYANCE APPARATUS

(75) Inventors: Naoki Ishikawa, Kashiwa (JP); Yasuo Fukatsu, Abiko (JP); Tsuyoshi Moriyama, Toride (JP); Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 493 days.

(21) Appl. No.: 12/340,808

(22) Filed: Dec. 22, 2008

(65) Prior Publication Data

US 2009/0166960 A1 Jul. 2, 2009

(30) Foreign Application Priority Data

Dec. 26, 2007 (JP) ..... 2007-334485

(51) Int. Cl.
*B65H 7/02* (2006.01)

(52) U.S. Cl. ..... 271/228; 271/226; 271/227; 271/248; 271/249; 271/250; 271/252; 271/261

(58) Field of Classification Search ..... 271/226–228, 271/248–250, 252, 261
See application file for complete search history.

(56) References Cited

U.S. PATENT DOCUMENTS 6,318,714 B1 * 11/2001 Beskitt et al. ..... 271/10.01
7,003,257 B2 2/2006 Yoshi et al.
2004/0046316 A1 * 3/2004 Tsuzawa ..... 271/264
2007/0040326 A1 * 2/2007 Noda et al. ..... 271/227
2007/0045949 A1 * 3/2007 Obuchi et al. ..... 271/293
2008/0240820 A1 * 10/2008 deJong et al. ..... 399/395
2009/0102112 A1 * 4/2009 Taguchi et al. ..... 270/58.07
2009/0283957 A1 * 11/2009 Fujita et al. ..... 271/10.12
2009/0295076 A1 * 12/2009 Kato et al. ..... 271/228
2009/0322012 A1 * 12/2009 Ishikawa et al. ..... 271/9.01

FOREIGN PATENT DOCUMENTS

JP 2005-156578 A 6/2005
JP 2006-16129 A 1/2006

* cited by examiner

*Primary Examiner* — Kaitlin Joerger
*Assistant Examiner* — Prasad Gokhale
(74) *Attorney, Agent, or Firm* — Rossi, Kimms & McDowell LLP

(57) ABSTRACT

A sheet conveyance apparatus capable of detecting a sheet end portion in a short time period even if sheets are conveyed at a narrow interval and at high speed, thus making it possible to expedite the start timing of a subsequent sheet alignment operation. In accordance with results of detection by lateral registration detection sensors performed when a sheet reaches a lateral registration detection sensor unit, the sensor unit is moved in a width direction for sheet end detection. Based on a moving distance of the sensor unit from a standby position to a position where the sheet end is detected, a shift amount to be shifted the sheet in the width direction, i.e., a lateral registration error, is computed.

19 Claims, 12 Drawing Sheets

SHEET CONVEYANCE APPARATUS

BACKGROUND OF THE INVENTION

1. Field of the Invention

The present invention relates to a sheet conveyance apparatus for conveying a sheet on which an image is formed.

2. Description of the Related Art

An image forming apparatus for image formation on a sheet has recently been utilized usually in combination with a sheet processing apparatus, which is called a finisher and connected to the body of the image forming apparatus. The finisher includes a sheet alignment unit for aligning sheets discharged from the image forming apparatus body at their side ends into a bundle, and stales or punches or sorts the bundle of sheets. At the sorting process, some finisher functions to offset sheet bundles in a direction perpendicular to a sheet conveyance direction (hereinafter referred to as the width direction) for distinguishing the sheet bundles from one another, and discharge the sheet bundles.

Since conveyed sheets must be aligned prior to being stapled or punched, information is needed that indicates a sheet movement amount required for the sheet alignment. Information on a movement amount of each sheet bundle is also required for the offset operation at the time of discharging the sheet bundles.

To determine the sheet movement amount, the position of a conveyed sheet in the width direction must be determined and the movement amount must be computed before execution of post-processing such as stapling. In Japanese Laid-open Patent Publication No. 2005-156578, it is proposed to detect a sheet end position by a sensor disposed to be movable in the sheet width direction, and compute the sheet movement amount required for the sheet alignment.

In U.S. Pat. No. 7,003,257, it is proposed to detect a sheet end portion by a plurality of sensors disposed on a punching apparatus for being moved together with the punching apparatus during the detection, thereby performing hole-punching with accuracy in a punching process. With this proposal, since the sensors can be moved using drive means of the punching apparatus, the arrangement can be simplified in construction and constructed at low cost.

Recently, it has been demanded that a sheet on which an image is formed by an image forming apparatus be efficiently discharged from a post-processing apparatus. However, with the increase in apparatus size and with the increase in types of sheet processing apparatuses used in combination with the image forming apparatus, a lateral misalignment of a sheet is liable to occur in the post-processing apparatus disposed downstream of the image forming apparatus. To improve the productivity in the arrangement where lateral misalignment of a sheet is liable to occur, the lateral misalignment must be computed in a short time period with accuracy.

In the above described prior art, there are proposed a method for detecting lateral misalignment and a method for accurately detecting a sheet end at the post-processing. However, with the increase in amount of lateral misalignment, the sheet side end is at a location more away from the sensor. Thus, the sensor must be moved for a longer distance to detect the sheet side end, and it takes much time to return the sensor to its original position after the sheet end detection. As a result, if the sheet is conveyed at high speed, the sheet side end cannot be detected in time, and the sensor cannot be returned to its original position before arrival of the next sheet. To obviate this, the sheet conveyance speed must be lowered or the sheet conveyance interval must be increased, posing a problem of reduction in productivity (sheet processing number per unit time).

SUMMARY OF THE INVENTION

The present invention provides a sheet conveyance apparatus capable of detecting a sheet end portion in a short time period to expedite the start timing of subsequent sheet alignment, even if the sheet conveyance interval is short and/or the sheet conveyance speed is high, and provides a control method for the sheet conveyance apparatus, an image forming apparatus having the sheet conveyance apparatus, a sheet processing apparatus having the sheet conveyance apparatus, and a program for causing a computer to execute the control method.

According to a first aspect of this invention, there is provided a sheet conveyance apparatus comprising a conveying unit configured to convey a sheet, a sensor unit including a plurality of sheet detection sensors configured to detect an end portion of a sheet conveyed by the conveying unit and arranged along a width direction perpendicular to a sheet conveyance direction, a drive unit configured to move the sensor unit in the width direction, a drive control unit configured to determine a direction in which the sensor unit is to be moved from a standby position in accordance with results of detection by the plurality of sheet detection sensors of when the sensor unit is at the standby position and configured to control the drive unit such that the sensor unit is moved in the determined direction, and a shift amount detection unit configured to detect a shift amount by which the sheet conveyed by the conveying unit is to be shifted in the width direction based on results of detection by the plurality of sheet detection sensors and a moving distance of the sensor unit from the standby position to a position where a change occurs in any of the results of detection by the plurality of sheet detection sensors while the sensor unit is moving.

According to a second aspect of this invention, there is provided a control method for a sheet conveyance apparatus including a conveying unit for conveying a sheet, a sensor unit including a plurality of sheet detection sensors for detecting an end portion of a sheet conveyed by the conveying unit, the sheet detection sensors being arranged along a width direction perpendicular to a sheet conveyance direction, and a drive unit for moving the sensor unit in the width direction, the control method comprising a drive control step of determining a direction in which the sensor unit is to be moved from a standby position in accordance with results of detection by the plurality of sheet detection sensors of when the sensor unit is at the standby position and controlling the drive unit such that the sensor unit is moved in the determined direction, and a shift amount detection step of detecting a shift amount by which the sheet conveyed by the conveying unit is to be shifted in the width direction based on the results of detection by the plurality of sheet detection sensors and a moving distance of the sensor unit from the standby position to a position where a change occurs in any of the results of detection by the plurality of sheet detection sensors while the sensor unit is moving.

According to a third aspect of this invention, there is provided an image forming apparatus having the sheet conveyance apparatus of this invention.

According to a fourth aspect of this invention, there is provided a sheet processing apparatus having the sheet conveyance apparatus of this invention and adapted to be connected to an image forming apparatus.

According to a fifth aspect of this invention, there is provided a computer-readable program for causing a computer to execute the control method of this invention.

With the present invention, a distance for which the sensor unit is moved for detection of a sheet end portion can be decreased, making it possible to detect the sheet end portion in a short time period even if sheets are conveyed at a narrow interval at high speed. As a result, the time required for the detection of a lateral registration error can be shortened, and the start timing of a subsequent sheet alignment operation can be expedited to improve the productivity.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
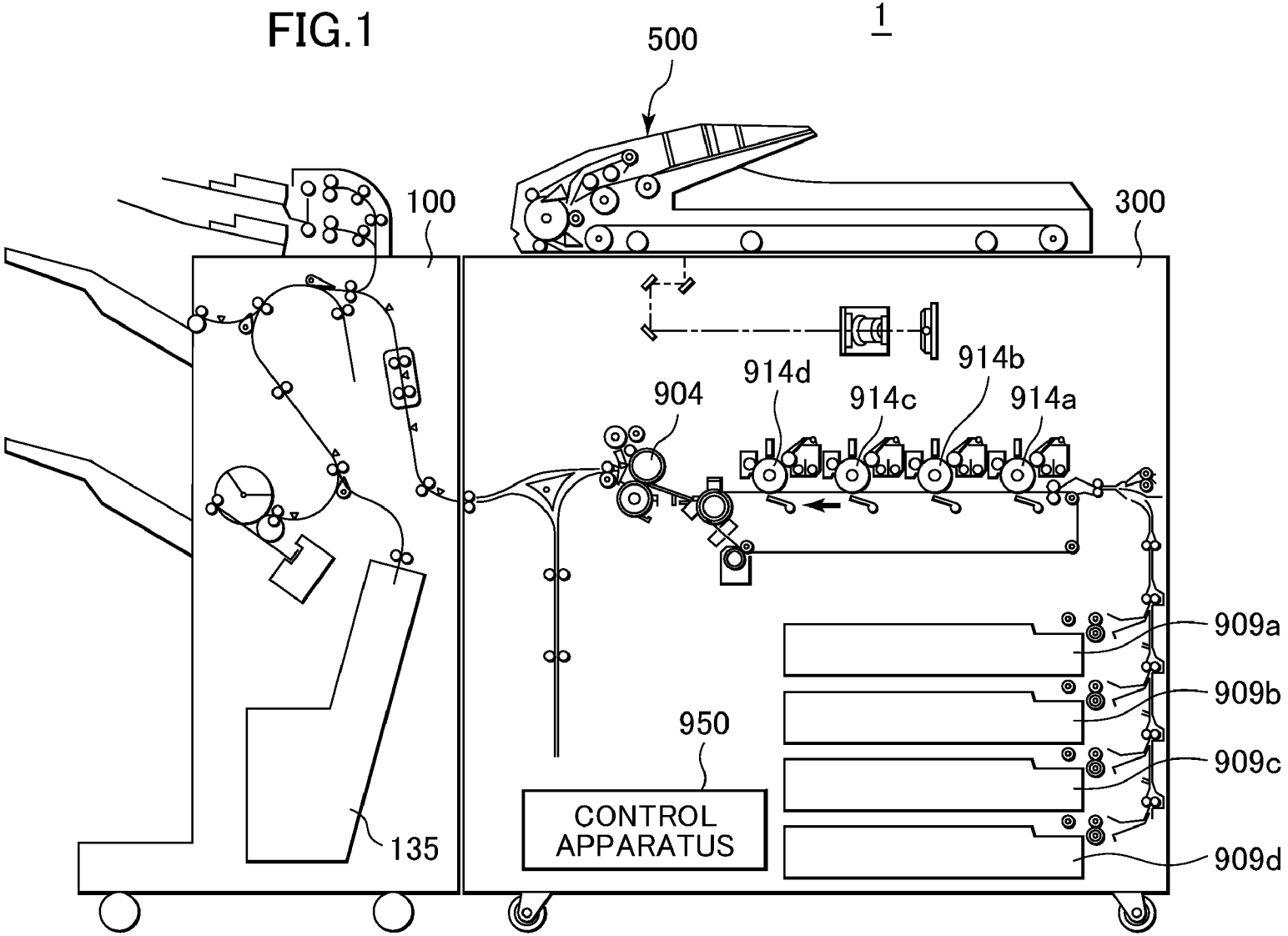
FIG. 1 is a vertical cross section view schematically showing the construction of an image forming system comprised of an image forming apparatus and a sheet processing apparatus having a sheet conveyance apparatus according to one embodiment of this invention.

FIG. 1 schematically shows in vertical cross section the construction of an image forming system including an image forming apparatus and a sheet processing apparatus having a sheet conveyance apparatus according to one embodiment of this invention.

The image forming system 1 is comprised of a monochromatic/color copying machine body (hereinafter referred to as the copying machine body) 300 and a sheet processing apparatus 100 connected to the copying machine body 300.

The copying machine body 300 includes an automatic document feeder 500, photosensitive drums 914*a* to 914*d* for yellow, magenta, cyan, and black as image forming means, a fixing unit 904, and cassettes 909*a* to 909*d* for housing sheets. The copying machine body 300 further includes a control apparatus 950 for controlling the entire copying machine. Sheets are each fed from one of the cassettes 909*a* to 909*d*, and toner images of four colors are transferred onto the sheet by the photosensitive drums 914*a* to 914*d*, etc. The sheet is conveyed to the fixing unit 904 in which the toner images are fixed, and then discharged to the outside the copying machine body. It should be noted that the copying machine body 300 includes structural elements required for the copying machine, other than illustrated ones, but a description thereof will be omitted.

The sheet processing apparatus 100 includes a saddle-stitch processing section (saddle unit) 135 and a side-stitch processing section (not shown) as a sheet stacking unit. Sheets are discharged from the copying machine body 300 to the sheet processing apparatus 100 in which the sheets are online-processed. The term "online" indicates that the sheets are conveyed from the copying machine body 300 to the sheet processing apparatus 100 without intervention of a human operator and subjected to post-processing. In some cases, the sheet processing apparatus 100 is optionally used, and therefore the copying machine body 300 is configured to be capable of being used singly. It should be noted that the sheet processing apparatus 100 and the copying machine body 300 may be configured integrally with each other.

Next, with reference to FIG. 2, the sheet processing apparatus 100 will be described.

Figure 2:
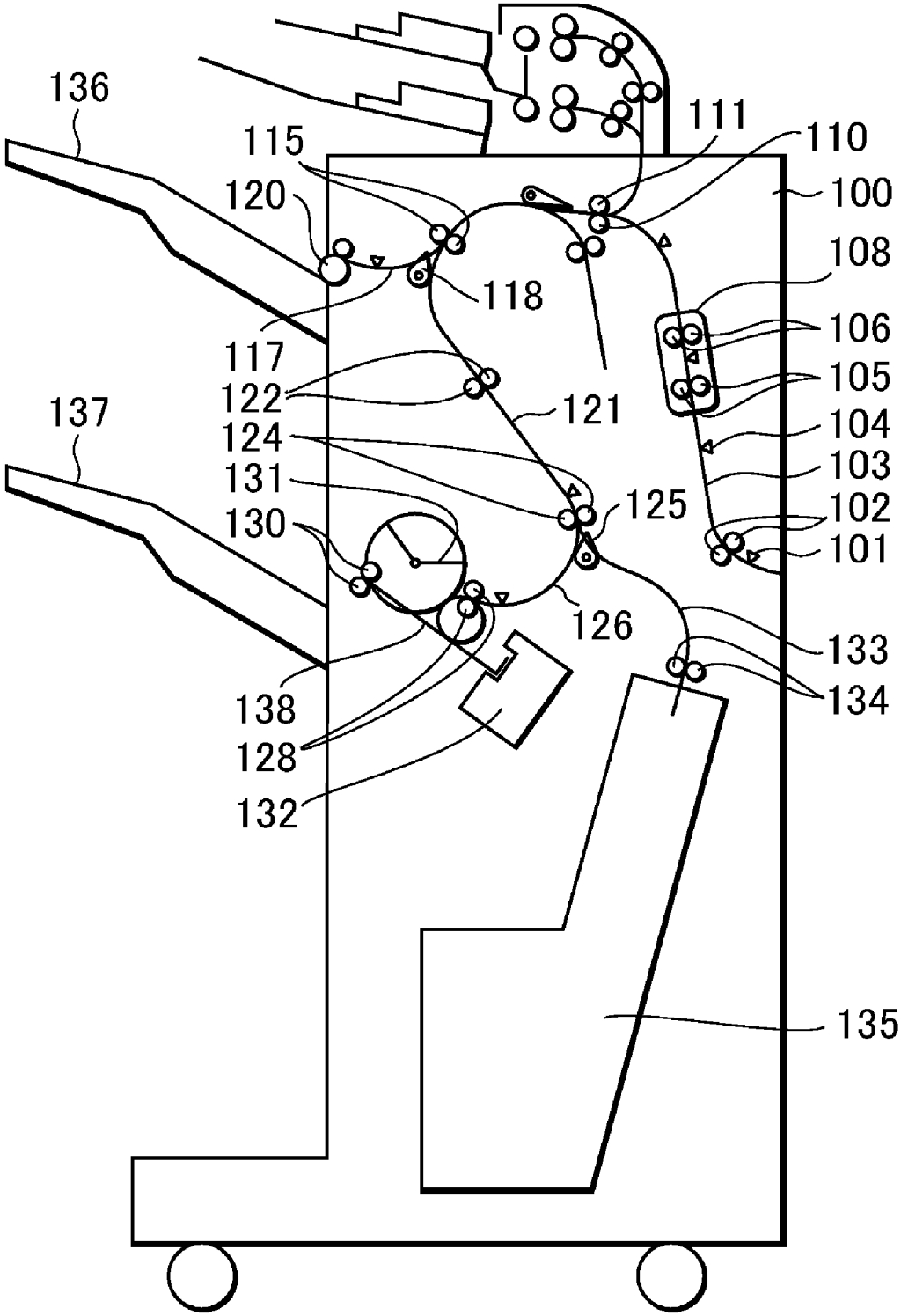
FIG. 2 is a vertical cross section view showing the details of the construction of the sheet processing apparatus in FIG. 1.

FIG. 2 shows in vertical cross section the details of the construction of the sheet processing apparatus 100 in FIG. 1.

A sheet discharged from the copying machine body 300 is delivered to and received by a pair of inlet rollers 102 in the sheet processing apparatus 100. At this time, the sheet receipt timing is detected by an inlet sensor 101.

The sheet is conveyed by the inlet roller pair 102 and passes through a conveyance path 103. During that time, the position of an end portion (side end) of the sheet is detected by a lateral registration detection sensor unit 104. As a result, it is detected whether or not there is a misalignment of the sheet in the width direction (lateral direction) (hereinafter referred to as the "lateral registration error") with respect to the center position of the sheet processing apparatus 100.

After the lateral registration error is detected, the sheet is conveyed by pairs of shift rollers 105, 106 (conveying unit). During that time, a shift unit 108 is moved by a predetermined amount in the direction from the front to the rear of the drawing paper of FIG. 2, whereby a sheet shifting operation is performed. Subsequently, the sheet is conveyed by a conveying roller 110 and a separating roller 111 to a pair of buffer rollers 115. In a case that the sheet is discharged to an upper tray 136, an upper path changeover flapper 118 is switched by a solenoid or other driving means (not shown). Then, the sheet is introduced by the buffer roller pair 115 into an upper conveyance path 117, and then discharged by an upper sheet discharging roller 120 to the upper tray 136.

On the other hand, in a case that the sheet is not discharged to the upper tray 136, the sheet conveyed by the buffer roller pair 115 is introduced by the upper path changeover flapper 118 into a bundle conveyance path 121. Then, the sheet is caused to pass through conveyance paths by a pair of buffer rollers 122 and a pair of bundle conveying rollers 124.

In a case that the sheet is saddle-processed (saddle-stitch processed), a saddle path changeover flapper 125 is switched by a solenoid or other driving means (not shown) and the sheet is conveyed to a saddle path 133. Then, the sheet is introduced by a pair of saddle inlet rollers 134 to the saddle unit 135 in which saddle processing (saddle-stitch processing) is performed on the sheet. The saddle processing is an ordinary processing, and therefore a description thereof will be omitted.

In a case that the sheet is discharged to a lower tray 137, the sheet conveyed by the bundle conveying roller pair 124 is further conveyed by the saddle changeover flapper 125 to a lower path 126. Subsequently, the sheet is discharged by a pair of lower sheet discharging rollers 128 to an intermediate processing tray 138. A predetermined number of sheets are aligned on the intermediate processing tray 138 by means of returning means such as a paddle 131 and a knurled belt (not shown). Subsequently, these sheets are stitched by a stapler 132, where required, and then discharged by a pair of bundle discharge rollers 130 to the lower tray 137.

Figure 3:
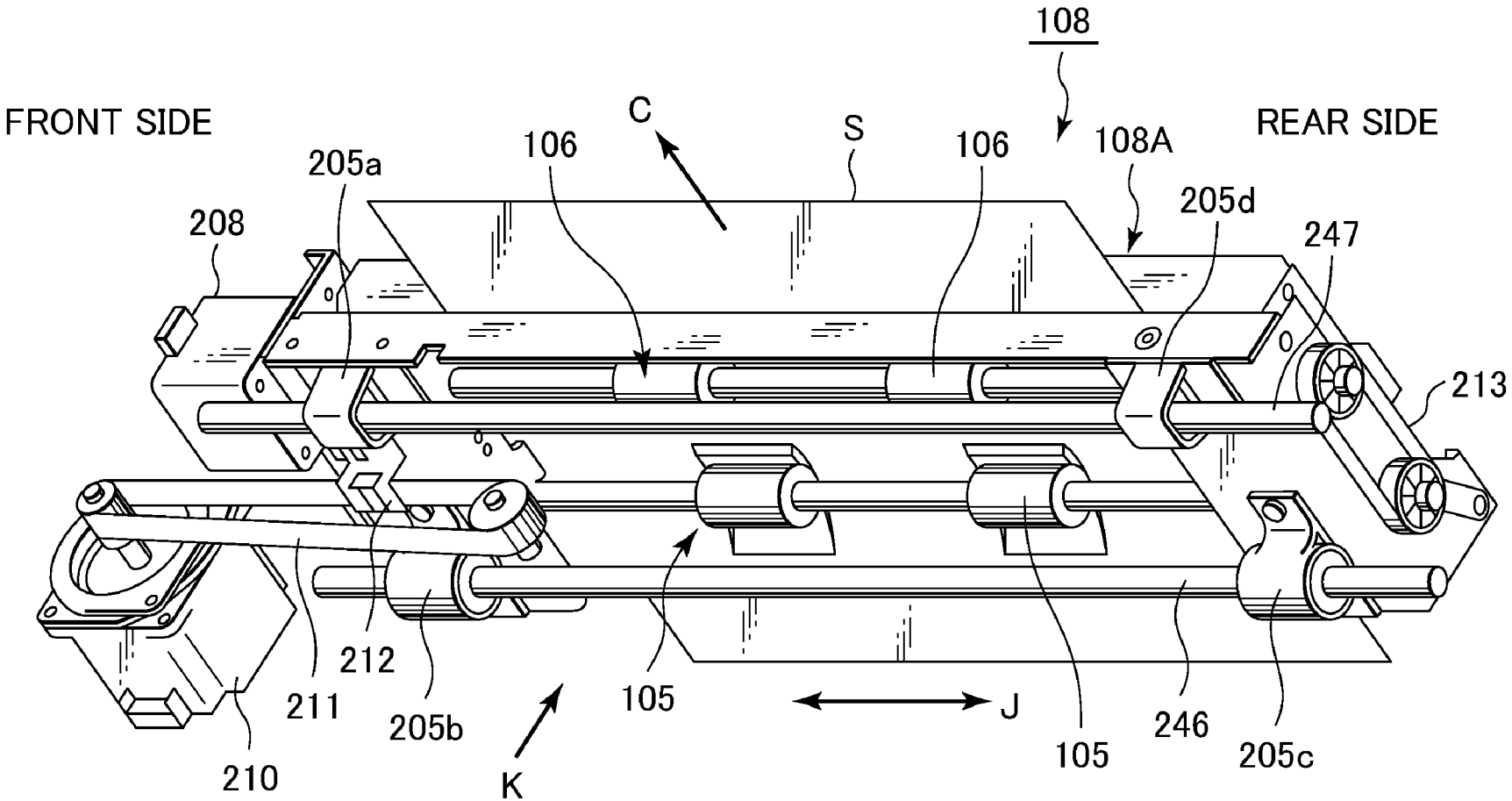
FIG. 3 is an external perspective view of a shift unit in FIG. 2.
Figure 4:
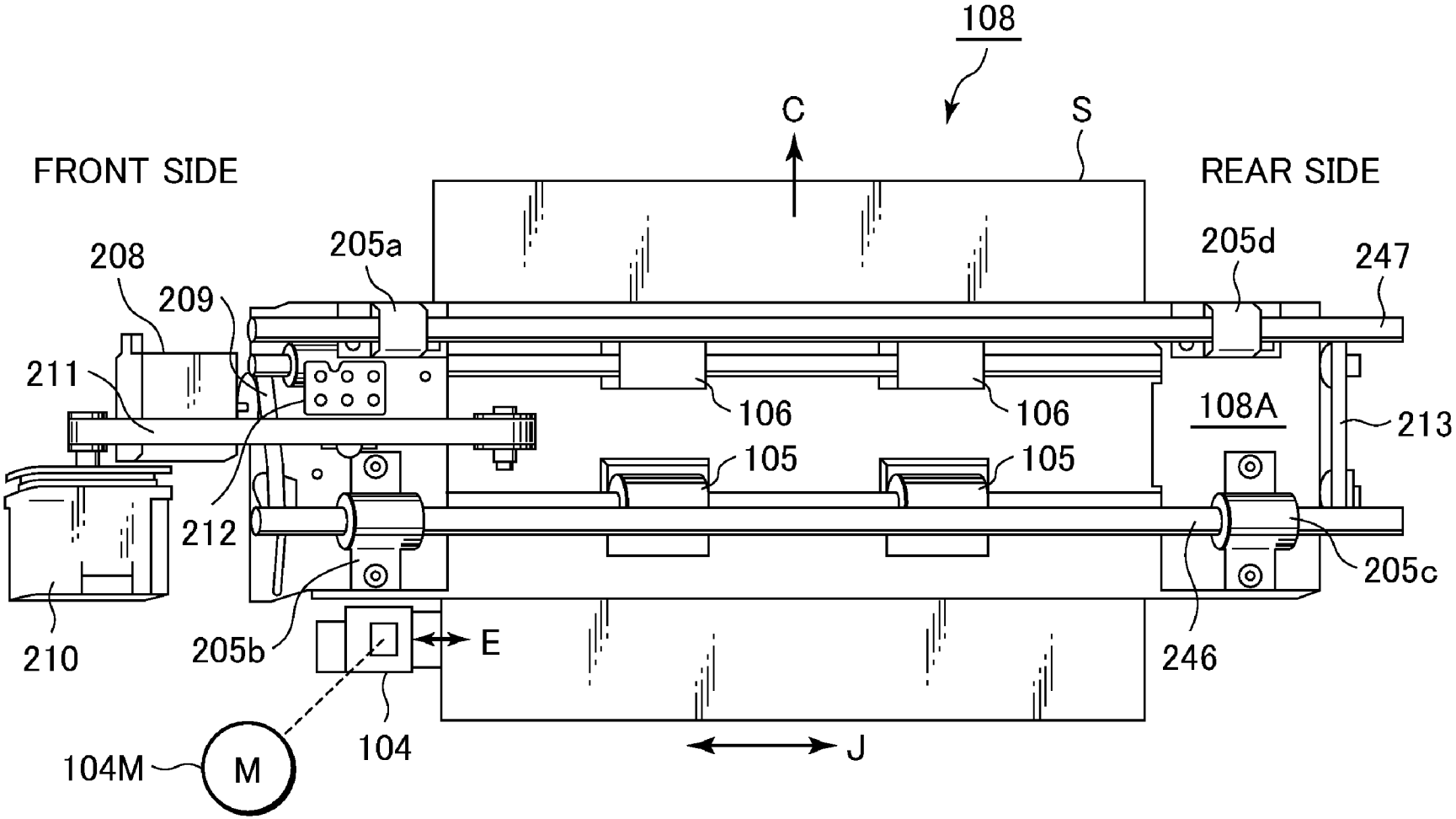
FIG. 4 is a view of the shift unit as seen from the direction of arrow K in FIG. 3.

FIG. 3 shows in external perspective view the shift unit 108 in FIG. 2, and FIG. 4 shows the shift unit 108 as seen from a direction of arrow K in FIG. 3. In FIGS. 3 and 4, a rear side of the sheet processing apparatus 100 corresponds to the right side of the drawings, and a front side of the apparatus corresponds to the left side of the drawings.

A frame 108A is supported by slide bushings 205*a*, 205*b*, 205*c*, 205*d* which are movable along slide rails 246, 247 fixed to the sheet processing apparatus 100. Thus, the frame 108A is able to reciprocate in a direction shown by arrow J along the slide rails 246, 247. The arrow J extends in a direction perpendicular to the sheet conveyance direction C. In other words, the arrow J extends in the sheet width direction.

A shift conveying motor 208 and the shift roller pairs 105, 106 are provided on the frame 108A. The shift conveying motor 208 is configured to rotate a rotary shaft of the shift roller pair 105 through a drive belt 209 (FIG. 4). The rotary shaft of the shift roller pair 105 is adapted to rotate the shift roller pair 106 via a drive belt 213.

The lateral registration detection sensor unit 104 (FIG. 4) and a shift motor 210 are provided upstream of the roller pair 105 as viewed in the sheet conveyance direction C. When receiving a signal for moving the frame 108A from a sheet processing apparatus controller 501 described below, the shift motor 210 circulates a drive belt 211. The drive belt 211 is connected to the frame 108A through a coupling member 212. Thus, the frame 108A is moved in the direction of arrow J by the circulation of the drive belt 211. The frame 108A is moved in the direction of arrow J in a state that the sheet S is held by the shift roller pairs 105, 106.

The lateral registration detection sensor unit 104 is moved in a direction of arrow E by means of a pulse motor 104M (drive nit) in order to detect the side end of the sheet S. The direction of arrow E extends in the same direction as the direction of arrow J.

Figure 5:
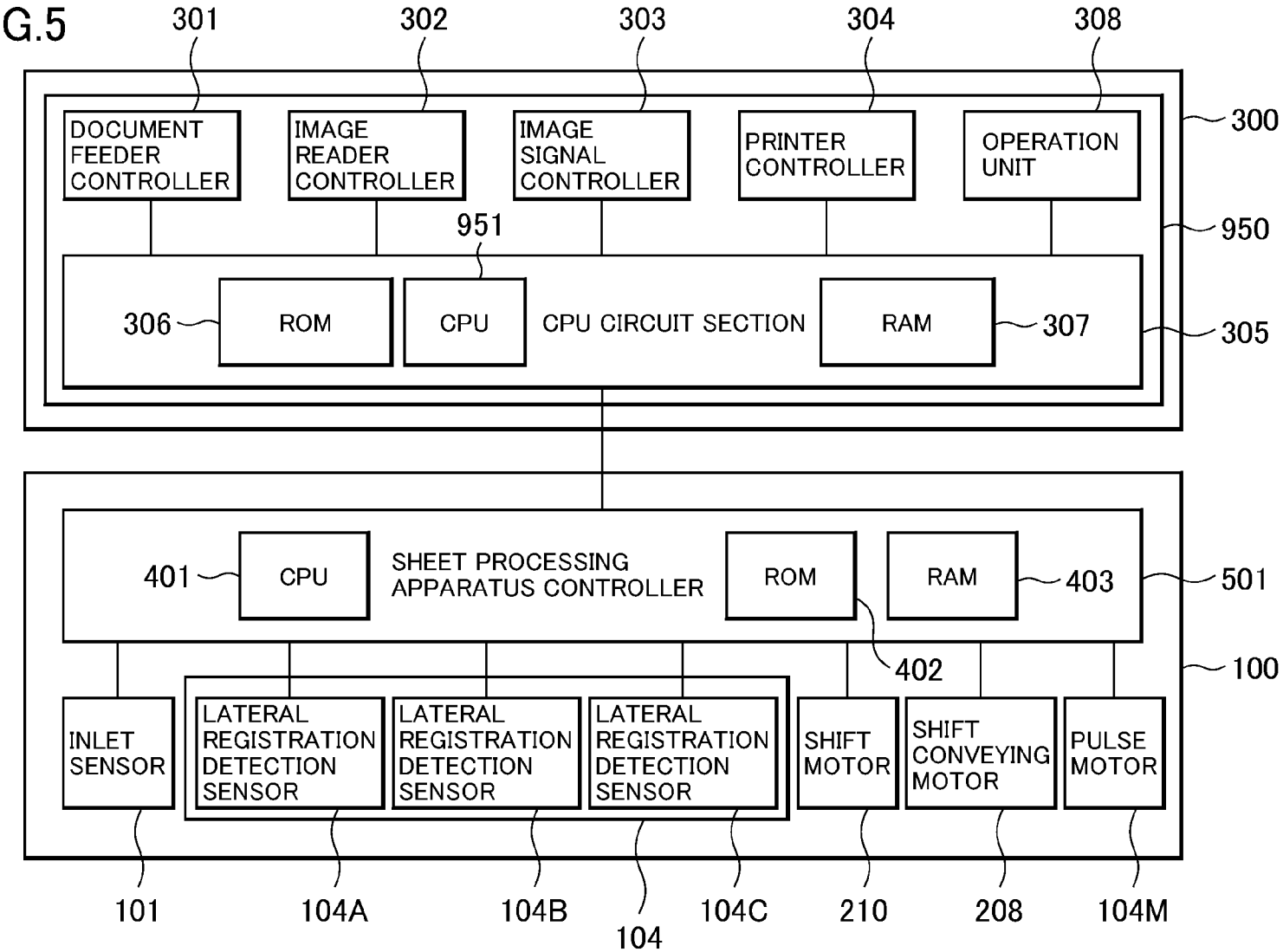
FIG. 5 is a block diagram showing the construction of a control apparatus in the copying machine body in FIG. 1 and a control section in the sheet processing apparatus.

FIG. 5 shows in block diagram the construction of a control unit 950 of the copying machine body 300 in FIG. 1 and the construction of the controller 501 of the sheet processing apparatus 100.

The control unit 950 of the copying machine body 300 includes a CPU circuit section 305 connected to the controller 501 of the sheet processing apparatus 100. The CPU circuit section 305 incorporates a CPU 951, a ROM 306, and a RAM 307. The CPU 951 of the CPU circuit section 305 reads and executes a control program stored in the ROM 306, thereby performing the overall control of a document feeder controller 301, an image reader controller 302, an image signal controller 303, a printer controller 304, an operation unit 308, and the sheet processing apparatus controller 501, which are connected to the CPU circuit section 305. The RAM 307 temporarily stores control data and is utilized as a work area for arithmetic processing associated with the control.

The document feeder controller 301 controls the drive of the automatic document feeder 500 in accordance with instructions from the CPU circuit section 305. The image reader controller 302 controls the drive of a light source and a lens system of an image reading section (not shown), and transfers an analog RGB image signal output from the lens system to the image signal controller 303. The image signal controller 303 converts the analog RGB image signal from the lens system into a digital signal, performs various processing on the digital signal, and converts the digital signal into a video signal for output to the printer controller 304. The processing operation of the image signal controller 303 is controlled by the CPU circuit section 305.

The operation unit 308 includes a plurality of keys for various settings for image formation, and a display section for displaying information indicating a state of settings. A key signal corresponding to a key manipulation on the operation unit 308 is supplied to the CPU circuit section 305, which functions as a computing unit and an input unit. Information based on a signal from the CPU circuit section 305 is displayed on the display section of the operation unit 308.

The sheet processing apparatus controller 501 mounted on the sheet processing apparatus 100 is adapted to control the drive of the entire sheet processing apparatus 100 by performing information data communication with the CPU circuit section 305 via a communication IC, not shown. The controller 501 includes a CPU 401, a ROM 402, and a RAM 403. In accordance with a control program stored in the ROM 402, the sheet processing apparatus controller 501 controls various actuators and sensors, such as for example, the inlet sensor 101, the lateral registration detection sensor unit 104, the shift motor 210, the shift conveying motor 208, and the pulse motor 104M for moving the sensor unit 104. The RAM 403 temporarily holds control data and is used as a work area for arithmetic processing associated with the control.

The lateral registration detection sensor unit 104 includes lateral registration detection sensors (sheet detection sensors) 104A, 104B, 104C for detecting a side end of a sheet S in order to detect how much lateral registration error is present with respect to the center position of the sheet processing apparatus. The sensor unit 104 is disposed upstream of the shift unit 108 in the sheet conveyance direction in order to compute an amount of correction for the lateral registration error.

Figure 6:
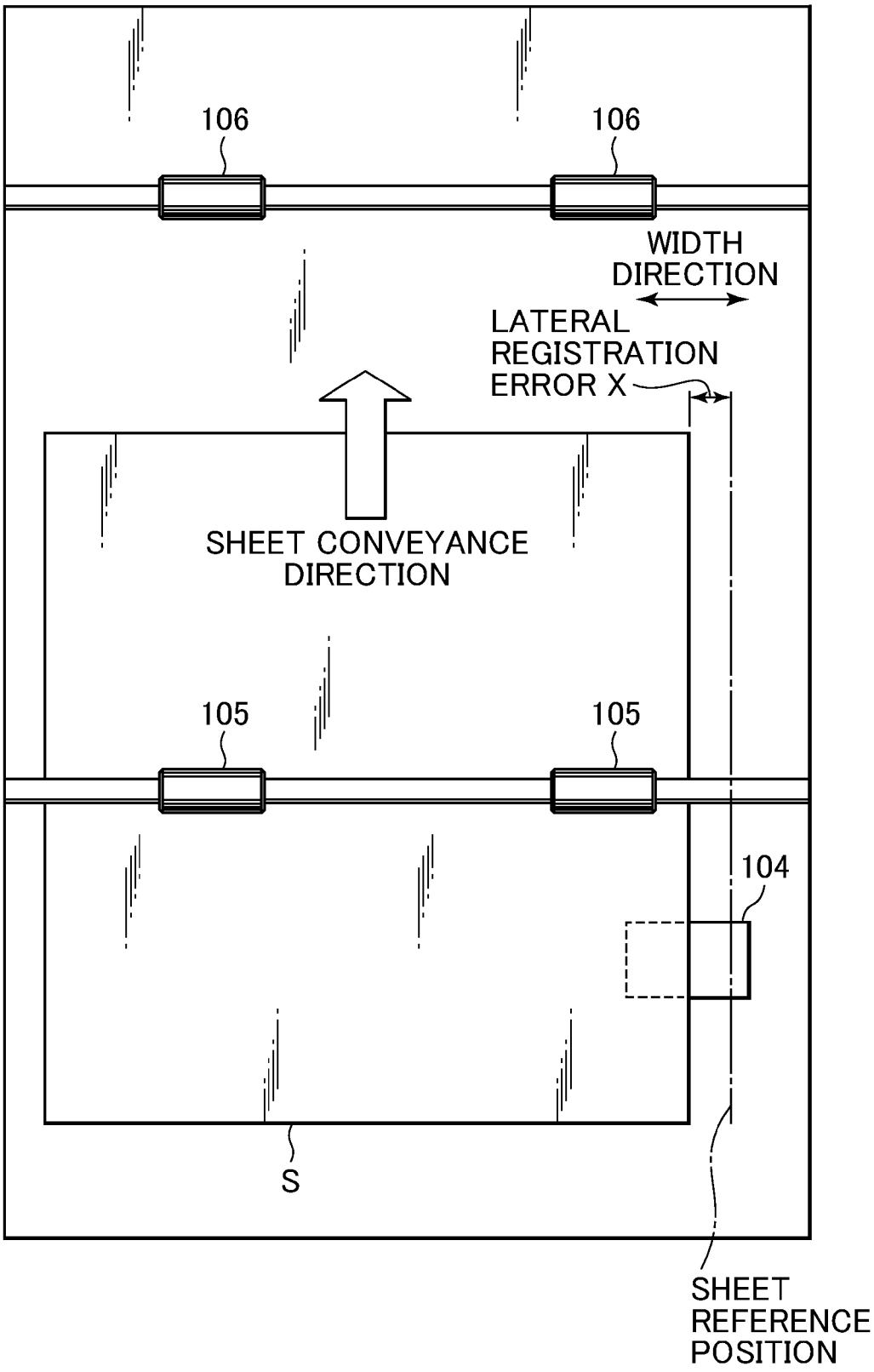
FIG. 6 is a view showing a lateral registration error produced when a sheet is conveyed in the shift unit.

FIG. 6 shows a lateral registration error of a sheet S being conveyed in the shift unit 108.

As show in FIG. 6, a sheet S is sometimes conveyed into the sheet processing apparatus in a state that it is deviated in the width direction by a distance X from a sheet reference position where there is no lateral registration error. The distance X indicates a lateral registration error X. In this embodiment, the lateral registration detection sensor unit 104 is moved in the sheet width direction in order to detect a side end portion of a sheet to thereby detect the lateral registration error X. It should be noted that the sheet reference position varies in dependence on sheet size.

Figure 7:
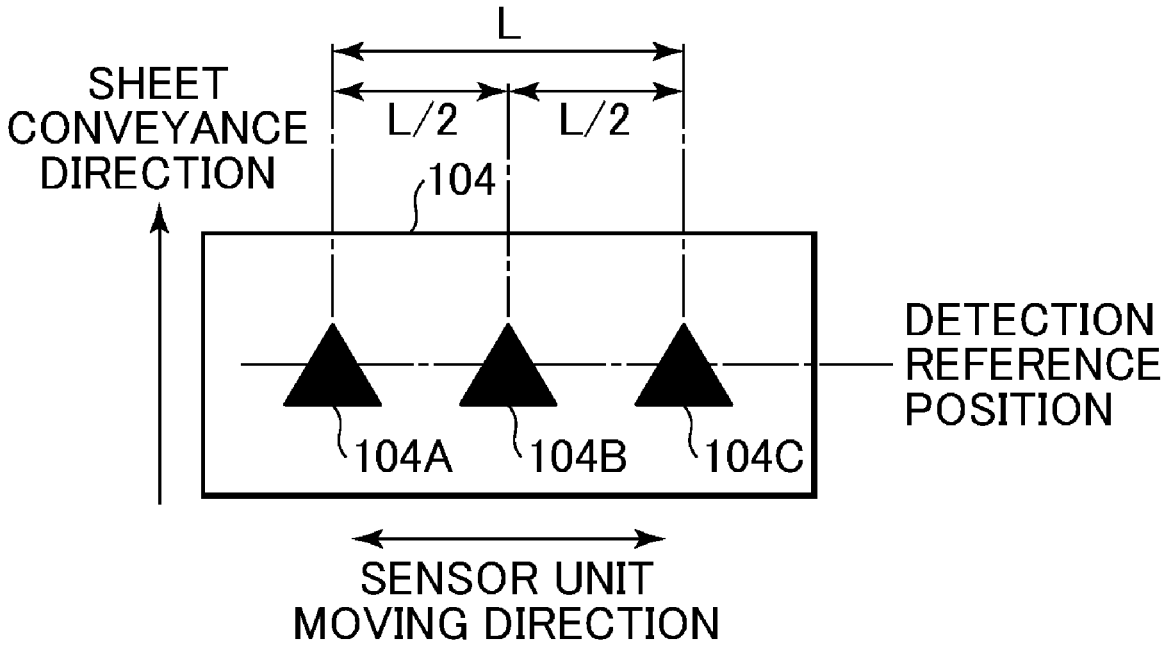
FIG. 7 is a view showing the arrangement of lateral registration detection sensors in a lateral registration detection sensor unit.

FIG. 7 shows how the lateral registration detection sensors 104A, 104B, 104C are arranged in the lateral registration detection sensor unit 104.

In the sensor unit 104, the lateral registration detection sensors 104A, 104B, 104C are arranged at equal intervals (L/2) as illustrated. The sensor unit 104 can be moved by the pulse motor 104M in the width direction of sheet S. The sensor unit 104 is moved in the sensor unit moving direction (width direction) illustrated in FIG. 7, and the detection sensors 104A, 104B, 104C detect an end portion (side end portion) of the sheet S which is conveyed to the detection reference position in the sheet conveyance direction. The detection reference position is on a line connecting the detection sensors 104A, 104B, 104C.

The lateral registration detection sensors 104A, 104B, 104C each have an output turned ON (high level) at the time of detecting a sheet and turned OFF (low level) at the time of not detecting a sheet. The CPU 401 of the sheet processing apparatus controller 501 is able to individually turn ON/OFF the power supply to the detection sensors 104A, 104B, 104C.

Figure 8:
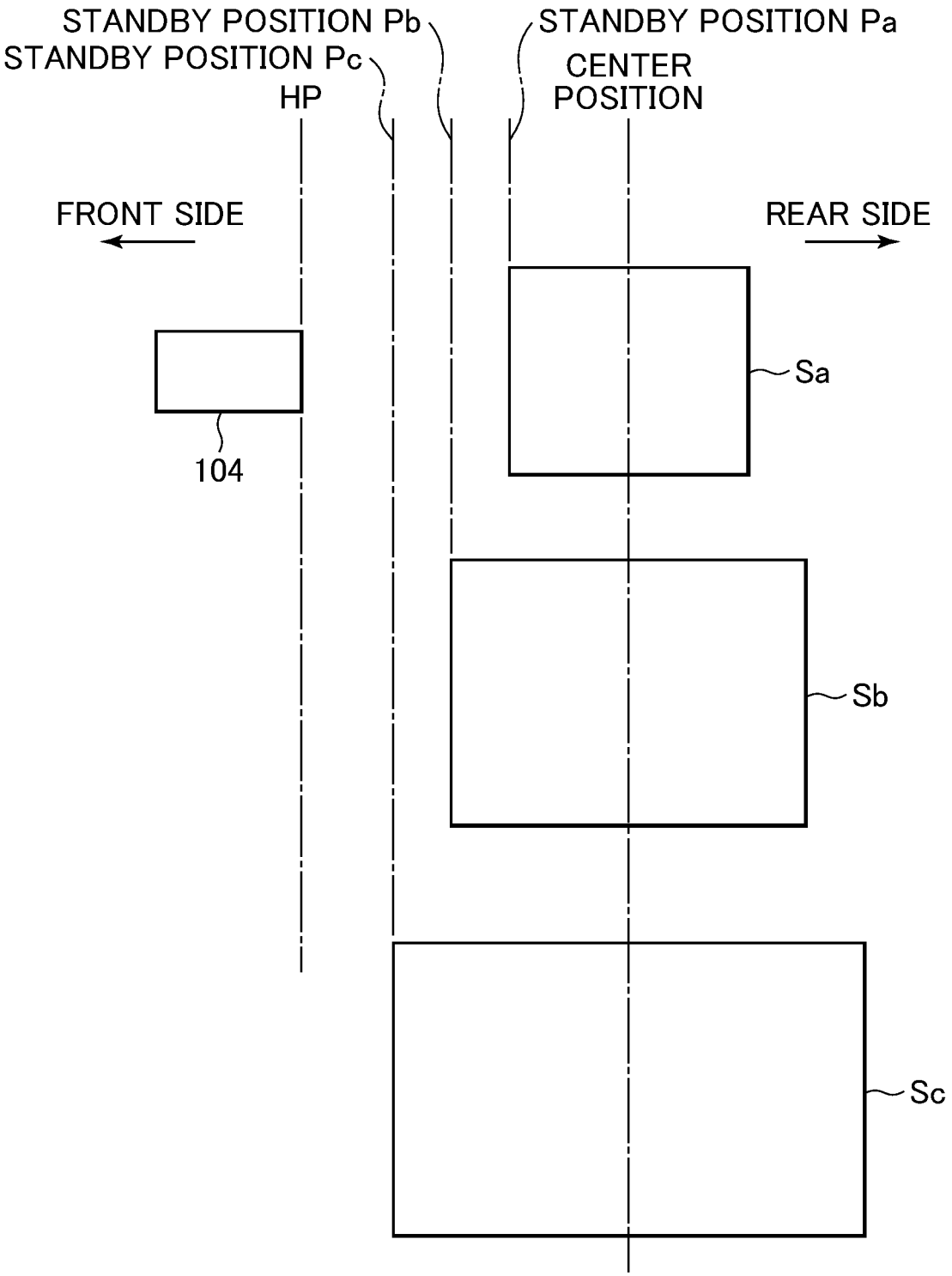
FIG. 8 is a view showing standby positions and an HP position of the lateral registration detection sensor unit.

FIG. 8 shows standby positions P and an HP position of the lateral registration detection sensor unit 104.

The sensor unit 104 is on standby at the home position (HP) when the sheet conveyance is not performed. The home position HP is located at a front most position and managed as a reference for the position of the sensor unit 104 in the width direction (for example, as a reference for standby positions Pa, Pb, Pc of the sensor unit 104). To this end, the home position HP is always detected by an HP detection sensor, not shown.

At start of sheet conveyance, the lateral registration detection sensor unit 104 is moved by the pulse motor 104M to the standby position P to wait for a sheet S being conveyed. In the illustrated example, the standby position P of the sensor unit 104 varies between Pa, Pb, and Pc in accordance with which of sheets Sa, Sb, Sc is conveyed, these sheets being different in sheet size. Each of the standby positions Pa, Pb, Pc is determined in accordance with the sheet size (sheet width) such that the standby position is at a position away by a distance equal to half of the sheet width from the center position of the sheet not deviated in the width direction. The standby positions Pa, Pb, Pc are determined in accordance with sheet information supplied from the copying machine body 300 (image forming apparatus) prior to the start of sheet conveyance.

As shown in FIG. 8, with the increase in the sheet size in a direction (width direction) perpendicular to the sheet conveyance direction, the standby position P is at a location closer to the front side (i.e., the front side of the drawing paper of FIG. 1). A distance from the home position HP to the standby position P is computed by the CPU 401 of the sheet processing apparatus controller 501. In accordance with the computed distance, the pulse motor 104M is driven, whereby the sensor unit 104 is moved to the standby position P.

Next, a description will be given of how a lateral registration error is detected using the three sensors 104A, 104B, 104C.

Prior to the start of sheet conveyance, the lateral registration detection sensor unit 104 is moved by the pulse motor 104M to the standby position P. As previously described, the standby position P is determined in accordance with the sheet size. In this embodiment, the standby position P is either one of Pa, Pb, and Pc.

Figure 9:
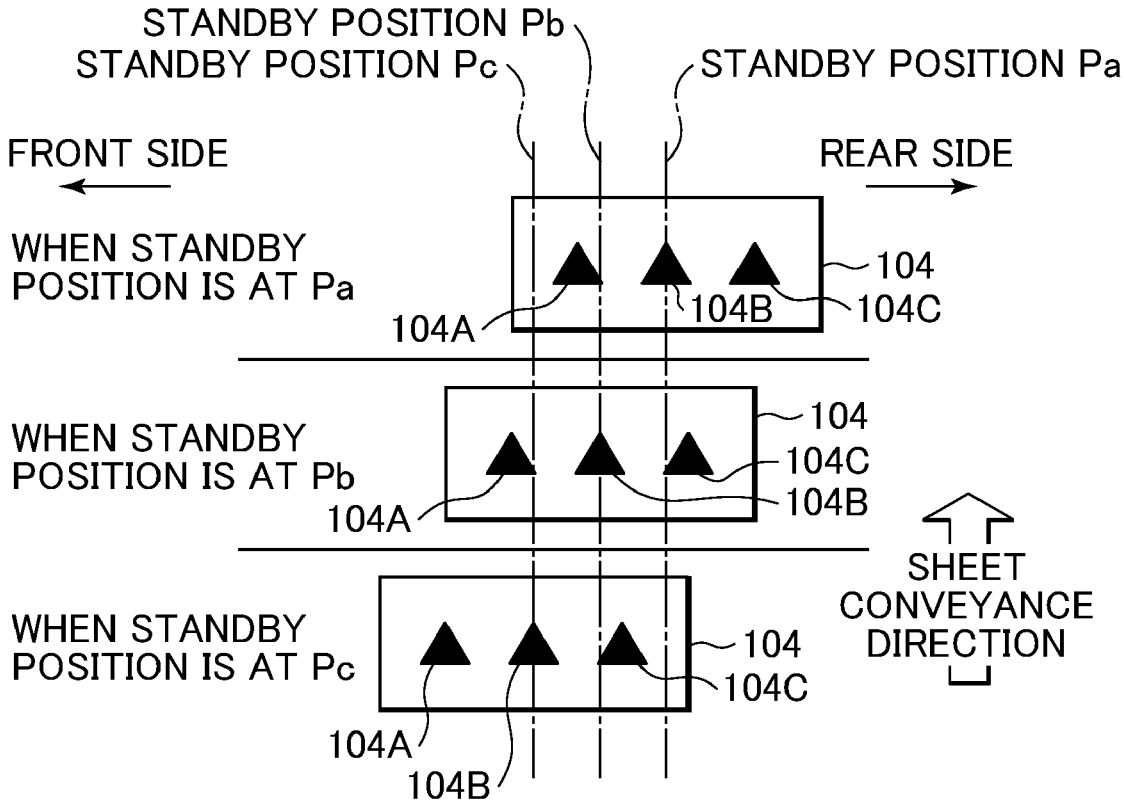
FIG. 9 is a view showing a relation between the lateral registration detection sensor unit and standby positions thereof.

FIG. 9 shows a relation between the standby positions Pa, Pb, Pc of the lateral registration detection sensor unit 104.

When the standby position P is at Pa, the sensor unit 104 is moved such that the detection sensor 104B located at the center of the three sensors 104A, 104B, 104C is positioned at the standby position Pa. At this time, the sensor unit 104 is moved rearward than the standby position Pa by one step by the pulse motor 104M to ensure that the sensor 104B is turned ON even when a sheet S reaches the sensor unit 104 in a state without any lateral registration error.

When the standby position P is at Pb, the sensor unit 104 is moved such that the sensor 104B at the center of the sensor unit is positioned to the standby position Pb. Similarly, when the standby position P is at Pc, the sensor unit 104 is moved such that the sensor 104B is positioned to the standby position Pc. After being moved to the standby position P, the sensor unit 104 waits for a sheet S being conveyed. As described above, the sensor 104B is moved to and made on standby at the standby position P coincident with the position of a side end of a sheet conveyed with no lateral registration error, whereby a lateral registration error can be detected based on the sheet end position. Since the sensor unit 104 is movable toward frontward and rearward by the pulse motor 104M, a sheet end portion can immediately be detected irrespective of whether the sheet S has a lateral registration error on the front side or the rear side with respect to the standby position P.

In this embodiment, a maximum lateral registration error with respect to the center position is represented by L. By positioning the sensor 104B at the standby position P, the sheet end portion can be detected by moving the sensor unit 104 by L/2, even if there occurs the maximum lateral registration error L. With the arrangement where three sensors are juxtaposed, a moving distance to a position for sheet end detection can be decreased by half as compared to a case using a single sensor, whereby time required for the lateral registration error detection can be shortened. Accordingly, as compared to the case of using one sensor for detection, an allowable sheet conveyance speed can be increased and a sheet conveyance interval can be shortened. Since the time required for lateral registration error detection is shortened, it is possible to expedite the start timing of a sheet alignment operation in the shift unit 108 performed after completion of the detection.

Next, when the conveyed sheet S reaches the lateral registration detection sensor unit 104, the sensor unit 104 is moved in a direction (width direction) perpendicular to the conveyance direction by the pulse motor 104M in order to detect the sheet end portion by the sensor unit 104. During the movement of the sensor unit 104, when an output of any of the sensors changes and the sheet end portion is detected, an amount of movement (moving distance) of the sensor unit 104 is computed. The movement amount D of the sensor unit 104 can be determined based on an advance amount s of the pulse motor 104M per one pulse and the number of pulses p required to move the sensor unit 104 from the standby position P to a position where the sheet end portion is detected.

$$\text{Movement amount } D = \text{Advance amount } s \times \text{Number of pulses } p$$

On the basis of the movement amount D computed in accordance with the above formula, the lateral registration error can be computed. Based on the computed lateral registration error, the sheet position is aligned (corrected) by the shift unit 108. After completion of the sheet end detection, the lateral registration detection sensor unit 104 is again moved to the standby position and is on standby to wait for arrival of the next sheet.

Next, a description will be given of a method for sheet end detection and lateral registration error calculation by the lateral registration detection sensor unit 104 with reference to FIG. 10.

Figure 10:
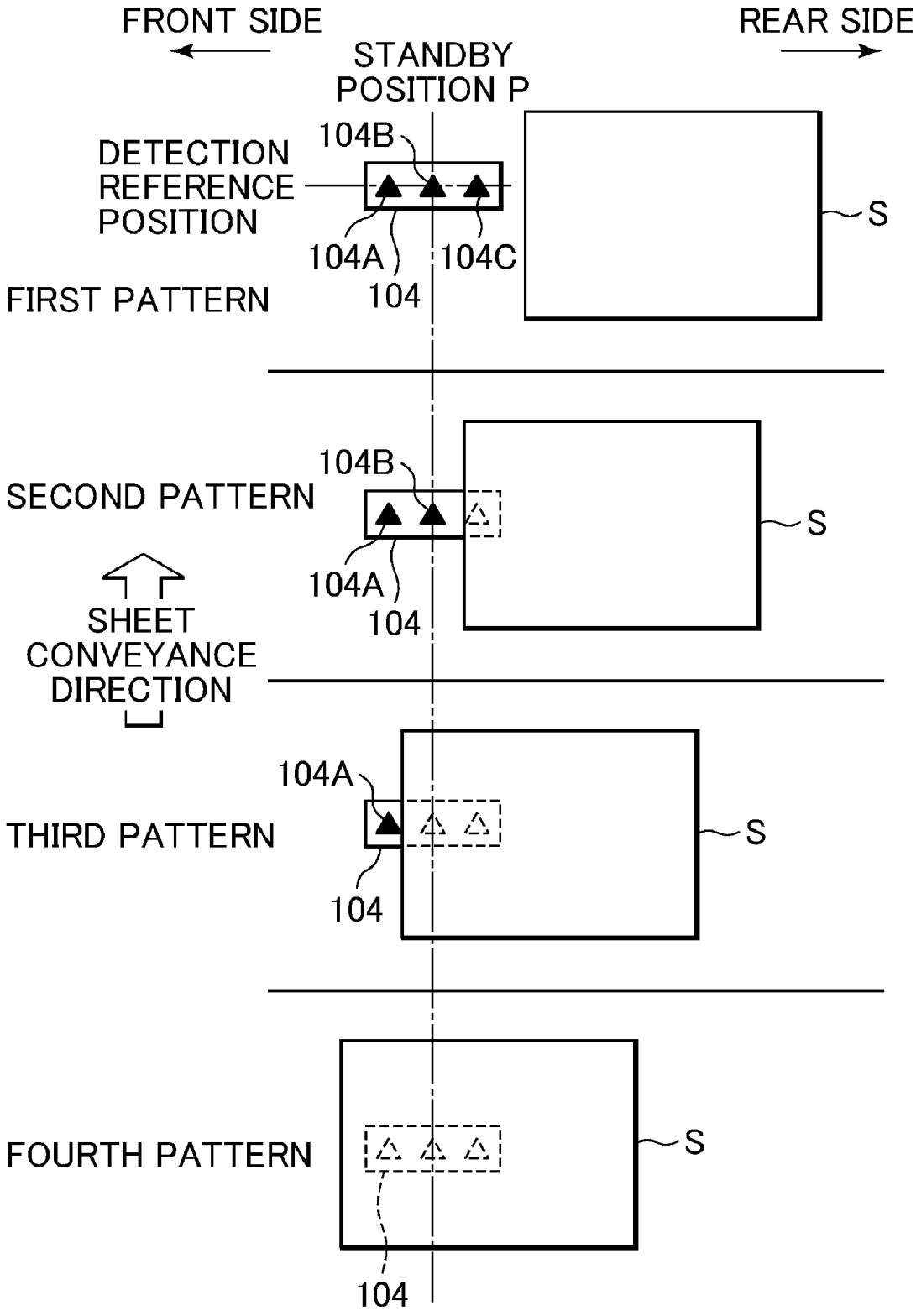
FIG. 10 is a view showing possible sheet lateral registration misalignment patterns.

FIG. 10 shows possible lateral registration misalignment patterns of a sheet S.

When it is determined that a sheet S reaches a detection reference position corresponding to the position of the sensor unit 104 as viewed in the sheet conveyance direction, the lateral registration detection sensors 104A, 104B, 104C start the sheet end detection.

First Detection Method

In a case that a sheet S is not detected by any of the detection sensors 104A, 104B, 104C as shown in a first pattern illustrated in FIG. 10, the direction in which the sensor unit 104 is to be moved is determined as being toward rearward in FIG. 10 (a first direction in the width direction). Thus, the sensor unit 104 is moved from the standby position P toward rearward until the output from a predetermined sensor changes (in this example, until the sensor 104C changes from OFF to ON), and the sheet end potion is detected.

In a case that the sheet S is detected only by sensor 104C as shown in a second pattern, the direction in which the sensor unit 104 is to be moved is determined as being toward rearward (the first direction). Thus, the sensor unit 104 is moved rearward until the output from a predetermined sensor changes (in the example, until the sensor 104B changes from OFF to ON), and the sheet end portion is detected.

In a case that the sheet S is detected by the sensors 104B, 104C as shown in a third pattern, the direction in which the sensor unit 104 is to be moved is determined as being toward forward in FIG. 10 (a second direction in the width direction). Thus, the sensor unit 104 is moved forward until the output of a predetermined sensor changes (in the example, until the sensor 104B changes from ON to OFF), and the sheet end portion is detected.

In a case that the sheet S is detected by all the sensors 104A, 104B, 104C as shown in a fourth pattern, the direction in which the sensor unit 104 is to be moved is determined as being toward forward (the second direction). Thus, the sensor unit 104 is moved forward until the output of a predetermined sensor changes (in the example, until the sensor 104A changes from ON to OFF), and the sheet end portion is detected.

As described above, the direction in which the lateral registration detection sensor unit 104 is to be moved is determined in accordance with a state of sheet detection by the lateral registration detection sensors 104A to 104C.

After the sheet end portion is detected in any of the first to fourth patterns, a lateral registration error is determined in accordance with either one of the following formulae according to the sheet end detection pattern.

Lateral registration error $X$=Movement amount $D$+Sensor installation interval $L/2$ (for the first and fourth patterns)

Lateral registration error $X$=Movement amount $D$(for the second and third patterns)

Second Detection Method

In a case that the sheet S is not detected by any of the sensors 104A, 104B, 104C as shown in the first pattern, the direction in which the sensor unit 104 is to be moved is determined as being toward rearward in FIG. 10. Thus, the sensor unit 104 is moved rearward until the output of a predetermined sensor changes (in the example, until the sensor 104C changes from OFF to ON), and the sheet end portion is detected.

In a case that the sheet S is detected by only the sensor 104C as shown in the second pattern, the direction in which the sensor unit 104 is to be moved is determined as being toward forward in FIG. 10. Thus, the sensor unit 104 is moved forward until the output of a predetermined sensor changes (in the example, until the sensor 104C changes from ON to OFF), and the sheet end portion is detected.

In a case that the sheet S is detected by the sensors 104B, 104C as shown in the third pattern, the direction in which the sensor unit 104 is to be moved is determined as being toward rearward. Thus, the sensor unit 104 is moved rearward until the output of a predetermined sensor changes (in the example, until the sensor 104A changes from OFF to ON), and the sheet end portion is detected.

In a case that the sheet S is detected by all the sensors 104A, 104B, 104C as shown in the fourth pattern, the direction in which the sensor unit 104 is to be moved is determined as being toward forward. Thus, the sensor unit 104 is moved forward until the output of a predetermined sensor changes (in the example, until the sensor 104A changes from ON to OFF), and the sheet end portion is detected.

After the sheet end portion is detected in any of the first to fourth patterns, a lateral registration error is determined in accordance with either one of the following formulae according to the sheet end detection pattern.

Lateral registration error $X$=Movement amount $D$+Sensor installation interval $L/2$ (for the first and fourth patterns)

Lateral registration error $X$=Sensor installation interval $L/2$−Movement amount $D$ (for the second and third patterns)

As described above, in accordance with the results of detection by the lateral registration detection sensors 104A to 104C performed when the sheet S reaches the lateral registration detection sensor unit 104, the direction in which the sensor unit 104 is to be moved is determined, the sensor unit 104 is moved in the determined direction from the standby position P by the pulse motor 104M, and the sheet end portion is detected. After the sheet end portion is detected, in accordance with the distance for which the sensor unit 104 has been moved until the output of a predetermined sensor changes (i.e., until the sheet end is detected), the lateral registration error is computed. More specifically, the lateral registration error is computed based on the movement amount D and the installation interval between the sensors 104A, 104B, and 104C, as described above.

When the input print job is completed, the lateral registration detection sensor unit 104 is returned to the home position HP and is on standby to wait for the start of the next job.

Next, with reference to a flowchart of FIG. 11, a description will be given of the flow from start to end of a job with respect to the sheet end detection and lateral registration error calculation by the lateral registration detection sensor unit 104.

Figure 11:
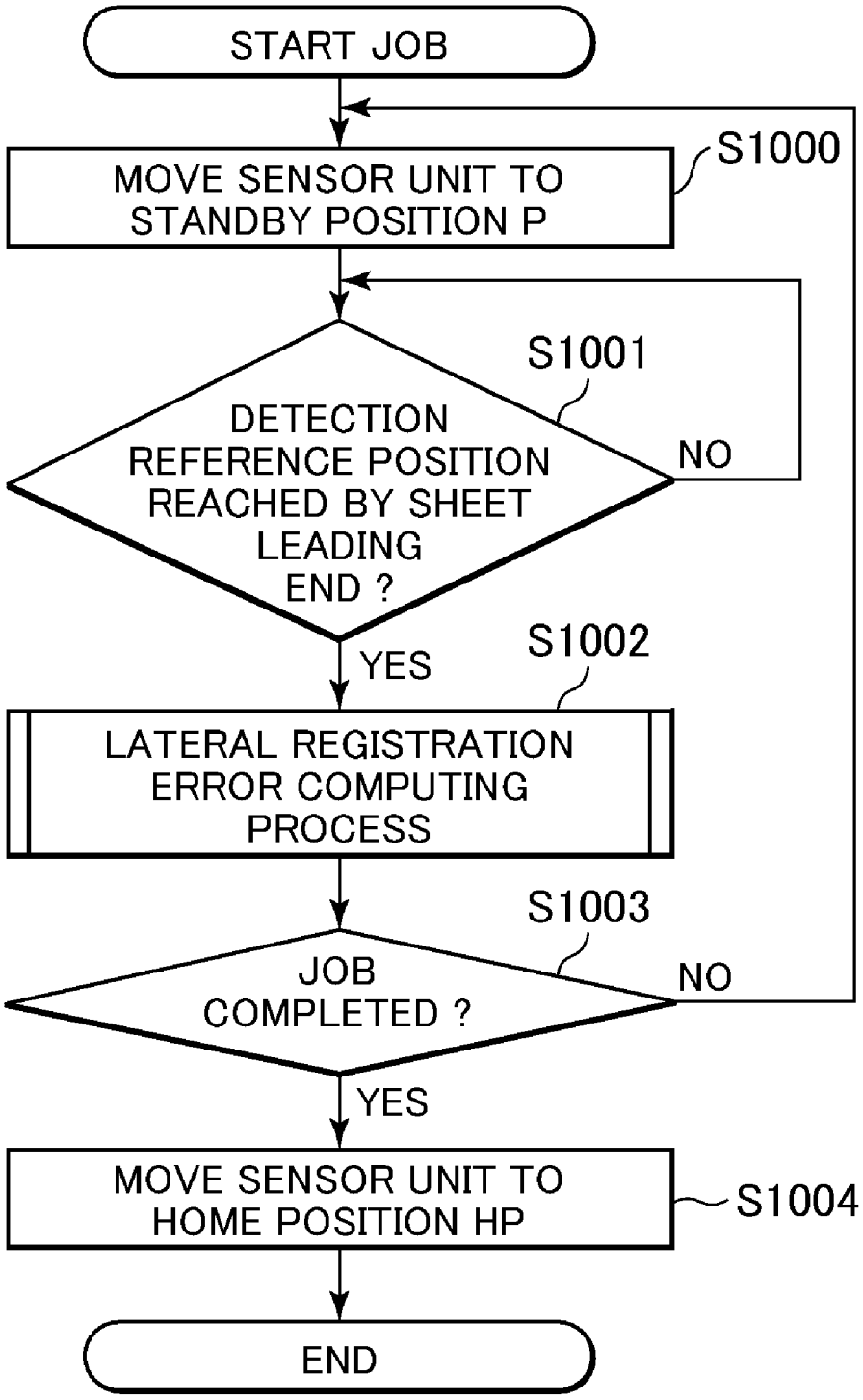
FIG. 11 is a flowchart showing the flow of sheet end detection and lateral registration error calculation by the lateral registration detection sensor unit.

FIG. 11 shows in flowchart the flow of the sheet end detection and lateral registration error calculation by the lateral registration detection sensor unit 104.

At start of a print job, the CPU 401 drives the pulse motor 104M to move the lateral registration detection sensor unit 104 to the standby position P (step S1000). Next, in step S1001, the CPU 401 determines whether or not a sheet leading end reaches a detection reference position, which corresponds to the position of the sensor unit 104 in the sheet conveyance direction. If it is determined that the sheet leading end reaches the detection reference position, the CPU 401 carries out a lateral registration error computing process (step S1002).

After completion of the lateral registration error calculation in step S1002, the CPU 401 determines whether or not the job is completed (step S1003). If the job is not completed, the flow returns to step S1000 in which the CPU 401 again moves the sensor unit 104 to the standby position P in order to detect a lateral registration error of a sheet subsequently conveyed. If it is determined that the job is completed, the CPU 401 moves the sensor unit 104 to the home position HP (step S1004).

Next, with reference to a flowchart of FIG. 12, the lateral registration error calculation (by the first detection method) will be described.

Figure 12:
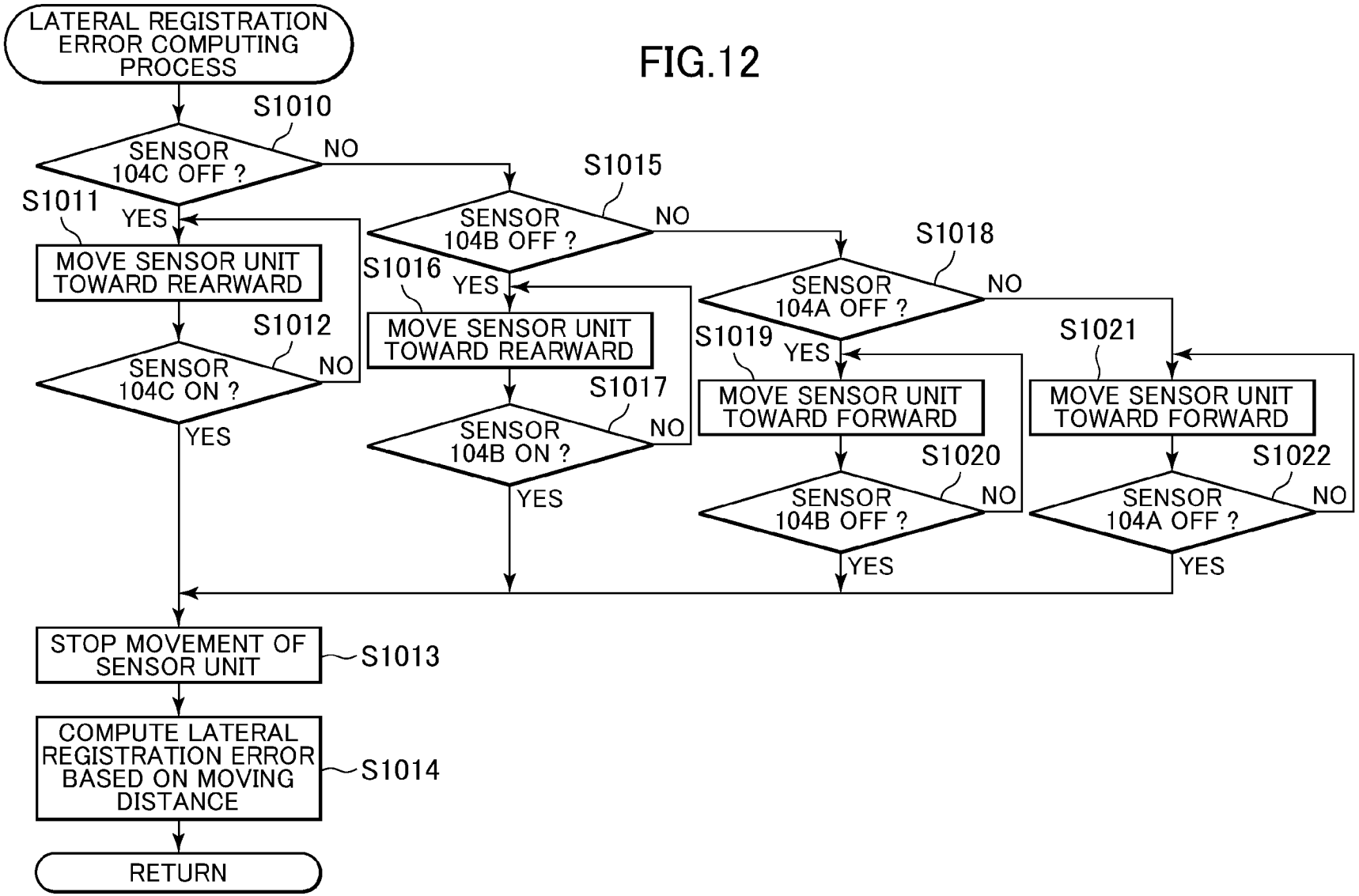
FIG. 12 is a flowchart showing the details of a lateral registration error computing process in step S1002 in FIG. 11.

FIG. 12 shows in flowchart the details of the lateral registration error computing process in step S1002 in FIG. 11.

In step S1010, the CPU 401 determines whether or not the lateral registration detection sensor 104C is in an OFF state, i.e., whether or not it detects a sheet. If it is determined that the sensor 104C is in an OFF state and does not detect a sheet, the flow proceeds to step S1011 in which the CPU 401 drives the pulse motor 104M to move the lateral registration detection sensor unit 104 toward rearward. Next, if it is determined in step S1012 that the sensor 104C changes from OFF to ON and detects a sheet end portion, the CPU 401 stops in step S1013 the drive of the pulse motor 104M to stop the movement of the sensor unit 104. After the movement of the sensor unit 104 is stopped, the CPU 401 computes in step S1014 a lateral registration error based on the moving distance from the standby position P to a position where the sheet end portion is detected, and the flow is returned to the main flow of FIG. 11 (i.e., proceeds to step S1003).

If it is determined in step S1010 that the sensor 104C is in an ON state, the flow proceeds to step S1015 in which the CPU 401 determines whether or not the sensor 104B is in an OFF state. If the sensor 104B is not in an OFF state, the flow proceeds to step S1016 in which the CPU 401 drives the pulse motor 104M to move the sensor unit 104 toward rearward. Next, if it is determined in step S1017 that the sensor 104B changes from OFF to ON and detects a sheet end portion, the flow proceeds to step S1013 in which the CPU 401 stops the movement of the sensor unit 104. After the movement of the sensor unit 104 is stopped, the CPU 401 computes in step S1014 a lateral registration error in accordance with a distance for which the sensor unit 104 is moved from the standby position P to a position where the sheet end portion is detected, and the flow is returned to the main flow. It should be noted that the sensor unit 104 can be moved forward in step S1016 and it can be determined that the sheet end portion is detected when it is determined in step S1017 that the sensor 104C changes from ON to OFF.

If it is determined in step S1015 that the sensor 104B is in an ON state and detects a sheet, the flow proceeds to step S1018 where the CPU 401 determines whether or not the sensor 104A is in an OFF state. If the sensor 104A is in an OFF state and does not detect a sheet, the flow proceeds to step S1019 where the CPU 401 drives the pulse motor 104M to move the sensor unit 104 toward forward.

If it is determined in step S1020 that the sensor 104B changes from ON to OFF and detects a sheet end portion, the CPU 401 stops the movement of the sensor unit 104 in step S1013. After the movement of the sensor unit 104 is stopped, the CPU 401 computes in step S1014 a lateral registration error based on a distance for which the sensor unit 104 is moved from the standby position P to the position where the sheet end portion is detected, and the flow returns to the main flow. It should be noted that the sensor unit 104 can be moved toward rearward in step S1019 and it can be determined that the sheet end portion is detected when it is determined in step S1020 that the sensor 104C changes from OFF to ON.

If it is determined in step S1018 that the sensor 104A is in an ON state, the flow proceeds to step S1021 in which the CPU 401 drives the pulse motor 104M to move the sensor unit 104 toward forward. Next, if it is determined in step S1022 that the sensor 104A changes from ON to OFF and a sheet end portion is detected, the CPU 401 stops the movement of the sensor unit 104 in step S1013. After the movement of the sensor unit 104 is stopped, the CPU 401 computes a lateral registration error in step S10114, and the flow returns to the main flow.

In the above described process, if the results of detection by the sensors 104A to 104C are the same as one another, the sensor unit 104 is moved such that the sheet end portion is detected by that one of the sensors 104A to 104C which is disposed at an outermost position. On the other hand, if the results of detection by the sensors 104A to 104C are different from one another, the sensor unit 104 is moved such that the sheet end portion is detected by that one of adjacent two sensors having different results of detection which is disposed on the inner or outer side. As a result, the distance by which the sensor unit 104 is moved for sheet end detection can be reduced and the time required for lateral registration error detection can be shortened.

In the above described embodiment, the direction in which the sensor unit 104 is to be moved is determined in accordance with the results of detection by the sensors 104A to 104C performed when the sheet S reaches the sensor unit 104. Then, the sensor unit 104 is moved in the determined moving direction and the sheet end portion is detected. Subsequently, on the basis of the distance for which the sensor unit 104 is moved from the standby position to the position where the sheet end portion is detected, a misalignment of the sheet in the width direction, i.e., a lateral registration error X, is computed. The misalignment of the sheet represents a shit amount by which the sheet is to be shifted in the width direction. Thus, a distance for which the sensor unit is moved for detection of the sheet end portion can be decreased, making it possible to detect the sheet end portion in a short time period even if sheets are conveyed at a narrow interval at high speed. As a result, the time required for the detection of a lateral registration error can be shortened, and the start timing of a subsequent sheet alignment operation can be expedited to improve the productivity. Since the time for detection of lateral registration error can be shortened with use of a plurality of low-priced photo sensors without using a high-priced line sensor such as a CCD line sensor or a CIS line sensor, the cost of sheet processing apparatus can be reduced.

In the above described embodiment, the lateral registration detection sensor unit 104 includes three sensors. However, the number of sensors is not limited to three, but two or four or more sensors may be arranged in the sensor unit. With the increase in the number of sensors arranged, an amount of movement of the sensor unit to a position for sheet end detection decreases, whereby the time required for sheet end detection can be shortened.

Any type of sensors capable of sheet end detection can be used for the lateral registration detection sensor unit 104. For example, the sensor unit can be configured to detect a sheet end portion based on transmission/reflection states of transmissive or reflective optical sensors which are arranged therein. The sensors are not limited to optical sensors, but may be mechanical sensors for mechanically detect a side end portion of a sheet.

In the above described embodiment, the case where this invention is applied to a sheet processing apparatus, but this invention can be applied to a single image forming apparatus.

It is to be understood that the present invention may also be accomplished by supplying a system or an apparatus with a storage medium in which a program code of software, which realizes the functions of the above described embodiment is stored and by causing a computer (or CPU or MPU) of the system or apparatus to read out and execute the program code stored in the storage medium. In that case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, and a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. The program code may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2007-334485, filed Dec. 26, 2007, which is hereby incorporated by reference herein in its entirety.

What is claimed is:

1. A sheet conveyance apparatus comprising:

a conveying unit configured to convey a sheet;

a sensor unit including a plurality of sheet detection sensors configured to detect an end portion of a sheet conveyed by said conveying unit and arranged along a width direction perpendicular to a sheet conveyance direction;

a drive unit configured to move said sensor unit in the width direction;

a drive control unit configured to determine a direction in which said sensor unit is to be moved from a standby position in accordance with results of detection by the plurality of sheet detection sensors of when said sensor unit is at the standby position and configured to control said drive unit such that said sensor unit is moved in the determined direction; and a shift amount detection unit configured to detect a shift amount by which the sheet conveyed by said conveying unit is to be shifted in the width direction based on results of detection by the plurality of sheet detection sensors and a moving distance of said sensor unit from the standby position to a position where a change occurs in any of the results of detection by the plurality of sheet detection sensors while said sensor unit is moving.

2. The sheet conveyance apparatus according to claim 1, said shift amount detection unit detects the shift amount based on the moving distance of said sensor unit and an interval at which the plurality of sheet detection sensors are arranged.

3. The sheet conveyance apparatus according to claim 1, the standby position of said sensor unit is changed in accordance with a size of the sheet.

4. The sheet conveyance apparatus according to claim 1, wherein said drive unit moves said sensor unit to the standby position after the shift amount is detected by said shift amount detection unit.

5. The sheet conveyance apparatus according to claim 1, wherein the standby position is at a position away by half a sheet width from a center position of the sheet conveyed with no misalignment in the width direction.

6. The sheet conveyance apparatus according to claim 1, wherein in accordance with results of detection by the plurality of sheet detection sensors of when said sensor unit is at the standby position, a sheet detection sensor to be used after said sensor unit is moved among the plurality of sheet detection sensors is determined.

7. The sheet conveyance apparatus according to claim 1, wherein in a case where each of results of detection by the plurality of sheet detection sensors of when said sensor unit is at the standby position are the same as one another, said sensor unit is moved by said drive unit such that the end portion of the sheet is detected by one of the plurality of sheet detection sensors which is disposed at an outermost position, and in a case where at least one of the results of detection by the plurality of sheet detection sensors differs from other results, said sensor unit is moved by said drive unit such that the end portion of the sheet is detected by that one of adjacent sheet detection sensors having different results of detection which is disposed toward a first direction in the width direction.

8. The sheet conveyance apparatus according to claim 1, wherein in a case where each of results of detection by the plurality of sheet detection sensors of when said sensor unit is at the standby position are the same as one another, said sensor unit is moved by said drive unit such that the end portion of the sheet is detected by that one of the plurality of sheet detection sensors which is disposed at an outermost position, and in a case where at least one of the results of detection by the plurality of sheet detection sensors differs from other results, said sensor unit is moved by said drive unit such that the end portion of the sheet is detected by that one of adjacent sheet detection sensors having different results of detection which is disposed toward a second direction in the width direction.

9. A control method for a sheet conveyance apparatus including a conveying unit for conveying a sheet, a sensor unit including a plurality of sheet detection sensors for detecting an end portion of a sheet conveyed by the conveying unit, the sheet detection sensors being arranged along a width direction perpendicular to a sheet conveyance direction, and a drive unit for moving the sensor unit in the width direction, the control method comprising:

a drive control step of determining a direction in which the sensor unit is to be moved from a standby position in accordance with results of detection by the plurality of sheet detection sensors of when the sensor unit is at the standby position and controlling the drive unit such that the sensor unit is moved in the determined direction; and a shift amount detection step of detecting a shift amount by which the sheet conveyed by the conveying unit is to be shifted in the width direction based on the results of detection by the plurality of sheet detection sensors and a moving distance of the sensor unit from the standby position to a position where a change occurs in any of the results of detection by the plurality of sheet detection sensors while said sensor unit is moving.

10. The control method according to claim 9, wherein in said shift amount detection step, the shift amount is detected based on the moving distance of the sensor unit and an interval at which the plurality of sheet detection sensors are arranged.

11. The control method according to claim 9, wherein the standby position of the sensor unit is changed in accordance with a size of the sheet.

12. The control method according to claim 9, wherein the sensor unit is moved by the drive unit to the standby position after the shift amount is detected in said shift amount detection step.

13. The control method according to claim 9, wherein the standby position is at a position away by half a sheet width from a center position of the sheet conveyed with no misalignment in the width direction.

14. The control method according to claim 9, wherein in accordance with results of detection by the plurality of sheet detection sensors of when the sensor unit is at the standby position, that one of the plurality of sheet detection sensors which is to be used after the sensor unit is moved is determined.

15. The control method according to claim 9, wherein in a case where each of results of detection by the plurality of sheet detection sensors of when the sensor unit is at the standby position are the same as one another, the sensor unit is moved by the drive unit such that the end portion of the sheet is detected by that one of the plurality of sheet detection sensors which is disposed at an outermost position, and in a case where at least one of the results of detection by the plurality of sheet detection sensors differs from other results, the sensor unit is moved by the drive unit such that the end portion of the sheet is detected by that one of adjacent sheet detection sensors having different results of detection which is disposed toward a first direction in the width direction.

16. The control method according to claim 9, wherein in a case where each of results of detection by the plurality of sheet detection sensors of when the sensor unit is at the standby position are the same as one another, the sensor unit is moved by the drive unit such that the end portion of the sheet is detected by that one of the plurality of sheet detection sensors which is disposed at an outermost position, and in a case where at least one of the results of detection by the plurality of sheet detection sensors differs from other results, the sensor unit is moved by the drive unit such that the end portion of the sheet is detected by that one of adjacent sheet detection sensors having different results of detection which is disposed toward a second direction in the width direction.

17. An image forming apparatus comprising the sheet conveyance apparatus as set forth in claim 1.

18. A sheet processing apparatus comprising the sheet conveyance apparatus as set forth in claim 1 and adapted to be connected to an image forming apparatus.

19. A non-transitory computer-readable medium storing a program for causing a computer to execute the control method as set forth in claim 9.

* * * * *